United States Patent [19]

Farina et al.

[11] 4,167,833

[45] Sep. 18, 1979

[54] OVERHEAD GARAGE DOOR OPENER

[75] Inventors: Richard C. Farina, Bricktown; Peter G. Sepesi, Bridgewater, both of N.J.

[73] Assignee: Metro-Dynamics, Inc., Bridgewater, N.J.

[21] Appl. No.: 819,114

[22] Filed: Jul. 26, 1977

[51] Int. Cl.[2] ..... E05F 15/20

[52] U.S. Cl. ..... 49/199; 49/357; 49/358

[58] Field of Search ..... 49/29, 357-360, 49/199, 200

[56] References Cited

U.S. PATENT DOCUMENTS

| | | | |
|---|---|---|---|
| 2,703,236 | 3/1955 | Verdier | 49/358 X |
| 3,348,336 | 10/1967 | Hashagen | 49/200 |
| 3,733,747 | 5/1973 | Fox et al. | 49/200 X |

FOREIGN PATENT DOCUMENTS

| | | | |
|---|---|---|---|
| 714959 | 8/1965 | Canada | 49/358 |

*Primary Examiner*—Kenneth Downey
*Attorney, Agent, or Firm*—Stanley W. Sokolowski

[57] ABSTRACT

An overhead garage door opener in which an actuating motor is secured to the door and is coupled to a capstan. A heavy cord, secured at one end to the garage wall above the door and at its other end near the back of the garage, is wound around the capstan. A motor control system such as a coded sound producing device and a time delay receiving circuit is disclosed, to start the motor to open or close the door.

4 Claims, 6 Drawing Figures

OVERHEAD GARAGE DOOR OPENER

BACKGROUND OF THE INVENTION

Overhead garage door opening devices employing motor driven chains, worms and cables are old in the art. They are characterized by their use of long rigid track members which must be secured to the garage structure. Many are heavy and of complicated construction.

Many prior art devices have been activated by the use of radio waves, light beams, or sound frequencies. Radio waves have not been entirely satisfactory because passing airplanes have been known to open garage doors when overhead due to their high powered signaling waves. Also, the light beams offer little protection from outsiders who wish to gain entrance to the garage enclosure.

Ultrasonic and sound waves, when used as signaling means, are subject to some of the same objections as radio waves. Prior art difficulties of this type have been eliminated in the present invention by the use of a time delay receiving circuit which provides motor power only after the signal has been received and decoded for a predetermined length of time. This feature eliminates unlawful entry by the use of a siren type of generator which produces continuously variable frequency values.

A feature of the present invention is the simplified manner in which the motor operates the door by the use of a heavy cord and a capstan.

Another feature of the present invention is its light, compact, easy to install construction.

A further feature is its safe operation resulting from its cord and capstan drive.

A further feature is its low voltage power supply which operates from an internal power source.

Still another feature of the invention is a time limit switch which removes power from the motor after a predetermined time interval and then operates a motor reversing switch to place the circuit in condition for a return operation.

Another feature is an efficient drive system which permits low input mechanical power of approximately 1/20 H.P.

Yet another feature is its capability of installation in substandard head room conditions as defined by the Architectural Standards Association.

SUMMARY

The invention comprises a system for operating an overhead garage door. In one preferred embodiment of the operating power for the door is responsive to remote controlled coded sound waves. A draw bar is rockably secured to the upper edge of the garage door for pulling the door along a designated path. An electric motor drivably coupled to a capstan is mounted on the upper end of the draw bar. A heavy cord is stretched horizontally under the garage ceiling and secured at one end above the door. The other end of the cord is held by a take up device which provides tension adjustment and a quick release if required. The cord is wound around the capstan for frictional engagement. The motor is indirectly controlled by a signal receiver, sensitive to a narrow band of coded sound waves. The output of the control circuit is connected to the electric motor for starting and stopping the door. When it is desired to open or close the door, a signal transmitter hand carried or mounted on a vehicle, sends out coded sound waves having a frequency and timing pattern corresponding to the narrow band in the receiver to operate the motor.

Additional details of the invention will be disclosed in the following description, taken in connection with the accompanying drawings.

DESCRIPTION OF THE PREFERRED EMBODIMENT

Figure 1:
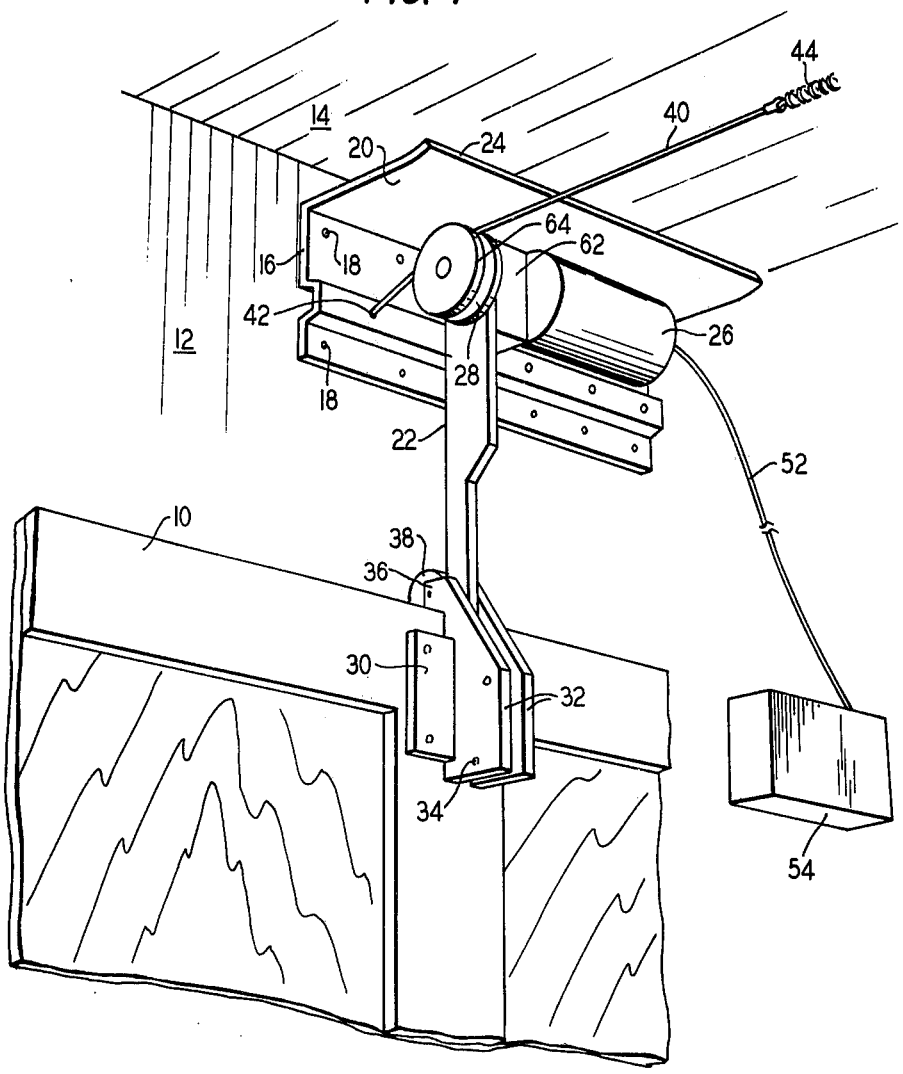
FIG. 1 is a perspective view of the door opener, showing a portion of the door and the electrical control units.
Figure 2:
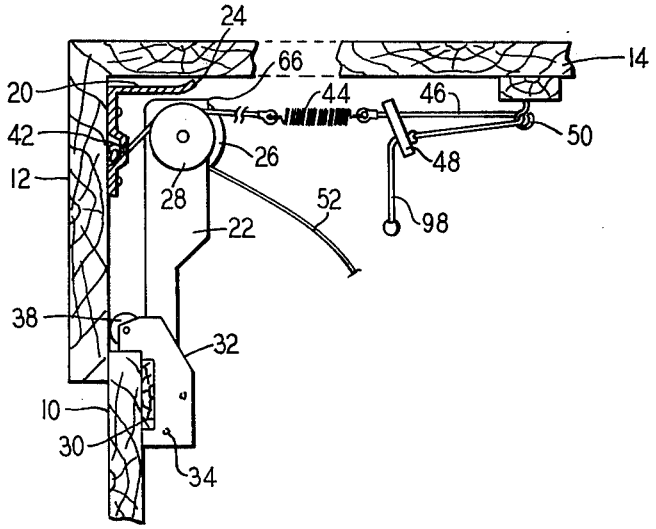
FIG. 2 is a side view of the door opener, with some parts in section, showing the door in its closed position.

Referring to FIGS. 1 through 4, a garage door 10 of the overhead opening type is shown inside a garage enclosure having a door aperture bordered by a wall 12, and a ceiling 14. On the inside surface of wall 12 an elongated flanged plate 16 is secured by bolts 18. The plate flange 20 forms a stop for the top of a draw bar 22, when the door is closed to prevent unauthorized opening of the door as by lifting it from outside. The outwardly extending flange 20 is bent as shown at 24 to form a guide for the top of the draw bar as the door closes. An electric motor 26 having a power capstan 28 coupled thereto is secured to the upper or free end of the draw bar. The draw bar 22 is fastened to the upper portion of the door 10 by means of a flanged support 30 having a guide plate 32, a pivot shaft 34, and a pair of offset projections 36 which freely carry roller 38. An elongated heavy cord 40 which may be ¼" rope or clothes line is secured at one end by passing it through an opening 42 in the flanged plate 16 and knotting it as shown in FIG. 2, and at its opposite end to a spring 44 which together with cord 46, take-up bar 48, and eyelet 50, comprise a tension adjuster and quick release. The flanged plate 16 and spring 44 are far enough apart to allow for the full travel of the door as hereinafter more fully described. The cord 40 may also be attached to the rear wall (not shown) near the ceiling. The cord attaching plate opening 42 and eyelet 50 is located so that the cord 40 is disposed along the path of the door 10.

Figure 6:
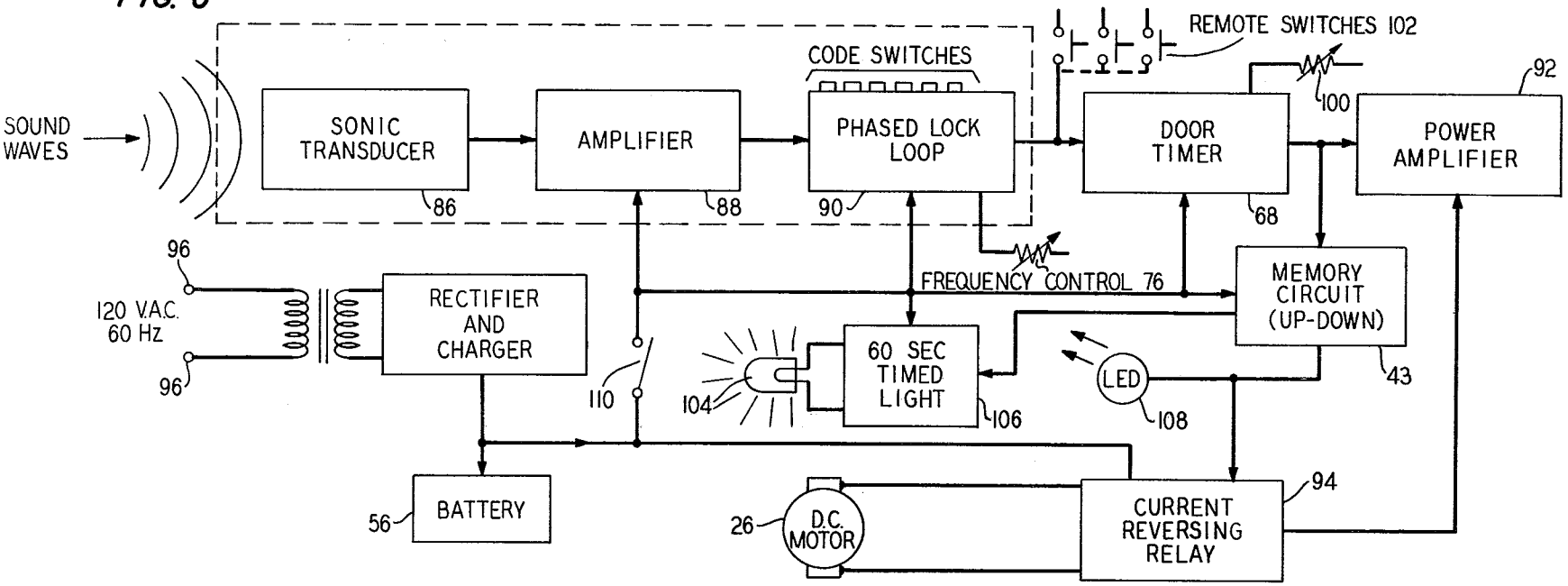
FIG. 6 is a diagramatic view of a wiring system, also in block form, showing the receiver, its power supply, and some of the control components.

The electric motor 26 is preferably a permanent magnet low voltage direct current motor which can be run on a battery and/or transformer. The motor 26 receives its power by means of a flexible conductor 52, connected to a receptacle 54 which houses the rechargable battery 56, a step-down transformer 58, and a rectifier 60 (FIG. 6). The motor 26 drives the capstan 28 through geared reduction 62 in an enclosed portion of the motor frame. The cord 40 is looped once around the capstan as shown at 64 in FIGS. 1 and 2. The top of the draw bar 22 is disposed in a vertical position beneath the flange 20 above the door. The extension 66 of the draw bar 22 effectively resists any vertical force that might be applied to the door by an intruder on the outside of the garage.

Figure 3:
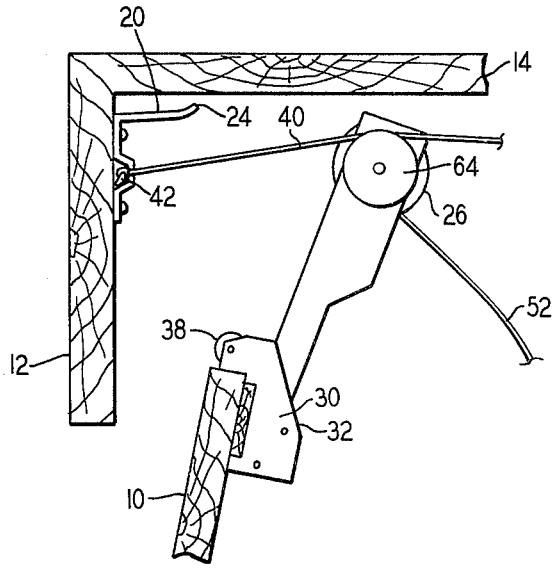
FIG. 3 is a diagramatic view, similar to FIG. 2 at the start of the door opening cycle.
Figure 4:
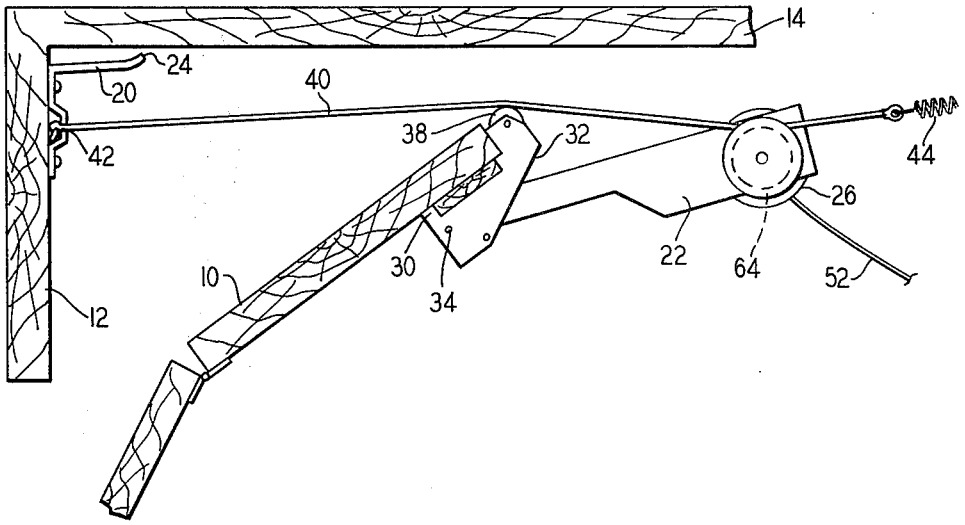
FIG. 4 is a view, similar to FIG. 3, but with the door opened an additional amount.

In the embodiment of the invention illustrated herein, when the door control system is to be operated to open the door, a signal is sent from a tuned transducer directed toward a detector located near the door. This signal is amplified and decoded and its output is used to activate the control circuit which then sends a reversible direct current power over flexible conductor cord 52 to the motor 26. The motor turns the capstan 28. Since the cord 40 is frictionally engaged around the capastan, the motor, the capstan, and the upper portion of the draw bar 22 connected to the door move toward the rear of the garage as shown in FIG. 3. During this motion, the draw bar 22 is free to rock about pivot shaft 34. Arcuate movement about pivot 34 positions extension 66 of bar 22 to avoid interference with flange extension 24 when garage door 10 is drawn upward. The actual path of the door sections is determined by the well-known lateral tracks (not shown) supplied with the door and generally differing in curvature and extent between different manufactured equipment. As the motor 26 and capstan 28 continue to turn, the draw bar 22 and door 10 are moved to the position shown in FIG. 4, the travel of the upper section of the door 10 being determined by the shape of the door track. This action continues until the door is fully opened. A time device shuts off the power and programs the motor in a reverse direction for the next operating cycle, as hereinafter more fully described.

The door is closed by a similar action. Again, coded sound waves are sent from a transducer circuit under manual control and the motor 26 and capstan 28 turn in a reverse direction to move the door toward its original, closed, position. The timer 68 (see FIG. 6) again shuts off the power and sends an operating pulse to an electronic memory circuit which reverses a relay, placing the power circuit in condition for an opening cycle. An external adjustment means permits setting the length of time of motor operation to compensate for friction, load, capstan slip and distance of door travel.

If an obstruction, such as a person or a part of an automobile, is under the bottom edge of the garage door as it closes, the temporary obstruction tends to support the door slightly, relaxing the loop 64 so as to cause slippage between the cord 40 and the capstan surface. In addition, there is provided a torque limiter in the nature of a starved Darlington transistor. Typically the torque of a permanent magnet D.C. motor increases as load increases, but the starved Darlington transistor limits the output of the motor and is soon turned off by the timer circuit. If the door is thus left in an intermediate position or if the timer fails to shut off the motor, cord 40 can be easily and quickly disengaged from capstan 28 by a yank on the hanging end of cord 98.

Figure 5:
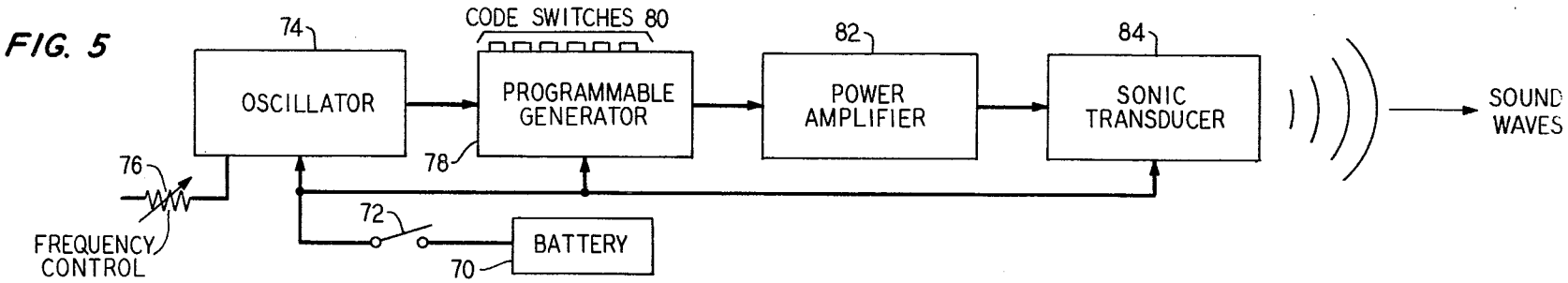
FIG. 5 is a diagramatic view of the wiring system of the transmitter in block form.

FIG. 5 is a diagramatic rendering of a transmitter which includes the transmitter battery 70, a manually operated switch 72, and an oscillator 74, adjusted to produce electrical alternating current at a predetermined frequency. Any type of oscillator may be employed such as the usual tank circuit, an astable free running multivibrator, or a feed-back means which employs a piezoelectric unit acting as its own frequency stabilizer. A frequency control component 76 is indicated as part of this circuit for more precise frequency tuning. The output of the oscillator 74 is further coded by a programmable generator 78 having a plurality of switches 80 by which the number and duration of signals are controlled. The output is applied to a power amplifier 82 and then to a sonic transducer 84 which may be a piezoelectric crystal or a conventional electromechanical device.

FIG. 6 shows the receiver circuit installed in the garage (in box 54, FIG. 1). The sound waves generated by transducer 84 are received by a similar transducer 86 which in this case, transforms the sound waves into electrical signals. These signals are applied to a receiver circuit 88 which increases their amplitude. The transducer can and will pick up sounds in the atmosphere of all frequencies with varying amplitude response. It is necessary to provide a band filter 90 to remove all spurious signals and pass only the toe and time coded frequencies sent via transducer 84. Any well tuned filter can be used for this purpose but a phase locked loop is preferable because it can be adjusted easily for frequency and time response with a frequency control 76 and a plurality of switches 80. Phased lock loops are old in the art and have been described in the technical literature.

The filtered signal decoded by the phased lock loop 90 is sent to a door timer circuit 68. The timer circuit 68 acts to close a starved Darlington type switch at the start of each operation, and keeps the switch closed for a predetermined time interval, long enough to permit the door to be fully opened or closed. A manually activated control 100 is used to adjust the "on" time cycle of the door. At the end of the time interval the switch is opened, cutting off the power to the motor 26. A power amplifier 92 receives a control signal from the timer 68 and applies direct current power path to the motor 26. A current reversing relay 94 is in series with the motor 26 and is operated by the memory circuit 43. This relay 94 switches the polarity of armature of motor 26 to reverse its rotary motion at the end of each complete timed operation.

A/C utility lines are connected to terminals 96 of a step-down transformer 58 which reduces the voltage and applies it to a rectifier circuit 60 producing direct current power which is applied to a storage battery except when the door is in motion. The battery 56 supplies all the power for the receiver components and is selected so that it can operate the receiver and motor for several opening and closing operations after an alternating current power failure. This provides the safety feature of system operation during a commercial power outage.

Other convenience components can be added to increase the usefullness of the receiver. A remote switch 102 may be installed and connected to the door timer 68 for opening or closing the garage door when the vehicle and its transmitter or the user's portable transmitter are not within operating range. Also, a lamp 104 can be connected to a second timer circuit 106 for providing light inside the garage each time the garage door is cycled. Such a light, shining for about one minute, gives the operator of the vehicle time to alight and turn on the usual garage lamps. As shown in FIG. 6, the second timer 106 is activated by the memory circuit 43.

A LED (light emitting diode) 108 is provided for the initial set-up of the system to obtain the proper phase of the electronics. Thus, with the door in the down position, most of the support electronics are in the stand-by position conserving power, and the illuminated LED serves the added function of indicating there is sufficient power available for operation of the system. An external input 102 is provided for operating the door by a key switch or door button from a remote location. The arrangement depicted is only exemplary. Another arrangement in which the draw bar is rigidly instead of pivotally secured to the guide plate is feasible with certain types of overhead door, and signal systems based on coded radio frequencies or light waves may be substituted for the sonic system described. Thus, while we have described our invention in connection with a specific embodiment thereof, it is clearly understood that this is done only by way of example and not as a limitation to the scope of any invention as set forth in the objects thereof and in the appended claims.

We claim:

1. An overhead garage door opener for a vertically movable garage door for attachment to the interior of a garage enclosure having a front wall and a ceiling, comprising at least one support secured to the garage door, at least one guide plate on the support extending outwardly thereof, an elongated draw bar swingably secured at one end thereof to the guide plate for (a) a vertical movement thereof coincident with vertical movement of the garage door, and (b) pivotal, motorized movement from a door-closed, vertical disposition thereof to a door-opening or door-closing, non-vertical disposition thereof, said draw bar having a free end extending therefrom, a reversible motor, having an output shaft, carried by the draw bar adjacent the free end thereof, a capstan coupled to the motor output shaft, a plate secured to the front wall of the garage above the door, an outwardly extending flange on said plate disposed in the path of vertical movement of said garage door and said draw bar, to prevent manually forced opening of said garage door, said flange overlying the free end of the bar when the door is in its closed position, an elongated cord secured at one end to the plate and at its other end to the garage structure remote from the front thereof, the cord being looped about the capstan intermediate its ends, cord tension means carried by the cord and means to activate the motor to open and close the garage door.

2. Apparatus according to claim 1 in which the cord loop is a single loop.

3. Apparatus according to claim 1 in which the motor actuating means is responsive to a remote control means.

4. Apparatus according to claim 1 further comprising take-up means whereby the cord tension may be adjusted and quickly released.

* * * * *